United States Patent [19]

Pischinger

[11] 4,380,222

[45] Apr. 19, 1983

[54] FUEL INJECTION PUMP FOR INTERNAL COMBUSTION ENGINES

[75] Inventor: Anton Pischinger, Graz, Austria

[73] Assignee: Friedmann & Maier Aktiengesellschaft, Hallein, Austria

[21] Appl. No.: 197,240

[22] Filed: Oct. 15, 1980

[30] Foreign Application Priority Data

Oct. 15, 1979 [AT] Austria ..... 6716/79

[51] Int. Cl.[3] ..... F02D 31/00

[52] U.S. Cl. ..... 123/365; 123/364

[58] Field of Search ..... 123/364, 365–374; 74/96

[56] References Cited

U.S. PATENT DOCUMENTS

| | | | |
|---|---|---|---|
| 1,746,579 | 2/1930 | Carter et al. | 123/364 |
| 1,967,101 | 7/1934 | Rassbach et al. | 123/364 |
| 2,053,682 | 9/1936 | Schagr | 123/365 |
| 3,401,569 | 9/1968 | Boyd | 74/96 |
| 3,566,849 | 3/1971 | Frick | 123/364 |
| 4,036,196 | 7/1977 | Hamilton | 123/364 |

FOREIGN PATENT DOCUMENTS

| | | | |
|---|---|---|---|
| 587825 | 10/1933 | Fed. Rep. of Germany | 123/364 |
| 548457 | 10/1942 | United Kingdom | 123/364 |
| 549210 | 11/1942 | United Kingdom | 123/364 |

*Primary Examiner*—Charles J. Myhre
*Assistant Examiner*—Magdalen Moy
*Attorney, Agent, or Firm*—Cushman, Darby & Cushman

[57] ABSTRACT

In internal combustion engines operated with fuel injection, particularly Diesel engines, of the type having injection pump (1) and injection nozzle (2) integrated to a constructional unit associated to one engine cylinder and having control of the fuel amount supplied by the pump effected by rotating the pump piston (4) provided with at least one oblique control edge giving free, in dependence on the rotational position, a back-flow bore for the fuel at an earlier or later moment, rotation of the pump piston is effected by means of a crank (11) having its crank pin extending parallel to the axis of the pump cylinder. The crank (11) is fixedly arranged on the driven end of the pump piston (4), i.e. either rigidly connected with the pump piston (4) or manufactured with the pump piston to form one single piece. The crank pin is protruding at the side of the driven end of the piston out of the fuel injection pump housing (1) and a control rod (13) arranged outside of the injection pump housing is acting on said crank pin.

3 Claims, 1 Drawing Figure

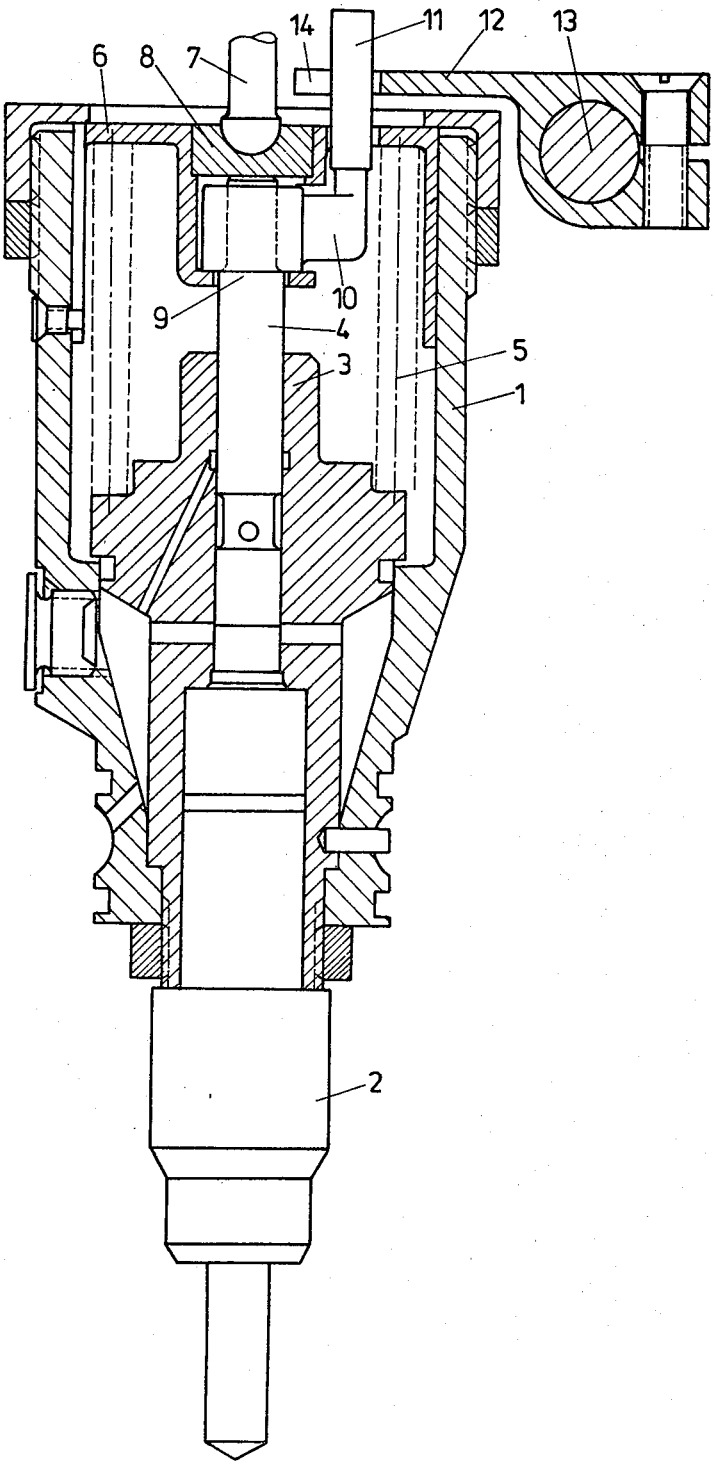
14
11
12
13
6
8
7
10
9
4
5
3
1
2

FUEL INJECTION PUMP FOR INTERNAL COMBUSTION ENGINES

The present invention refers to a fuel injection pump for internal combustion engines operated with fuel injection, in particular Diesel engines, of the type in which fuel injection pump and fuel injection nozzle are integrated to a constructional unit associated to one engine cylinder, the pump piston of the fuel injection pump being rotatable via a regulating member by a drive member for adjusting the amount of fuel injected and being loaded by a return spring acting on the pump piston against the action of the drive member with interposition of a spring washer, the regulating member being formed of a crank having a crank pin parallely extending relative to the piston axis and being rigidly connected to the piston or manufactured for forming with the piston one single piece, the crank being arranged at the driven end of the piston between drive member and spring washer, and the control rod acting on the crank pin. In a known fuel injection pump of this type, the control rod is arranged within the pump housing. Mounting of such a control rod is accompanied by substantial difficulties, in particular if with an in-line engine a plurality of constructional units comprising a fuel injection pump and a fuel injection nozzle and associated to one engine cylinder are provided. Also adjustment of the control appears to be difficult. There are also known arrangements in which the control rod is arranged outside of the constructional units formed of fuel injection pump and fuel injection nozzle each and in which the pump pistons of these constructional units are rotated via a control bushing which is acted upon by a short control rod extending out of the pump housing and being coupled to the control rod arranged outside the pump housing. With such arrangements one has to put up with a relatively complicated construction of the fuel injection pump because there must be provided a control bushing and a short control rod integrated with the fuel injection pump. With these constructions, the control rod arranged outside of the pump housing is acting on the short control rod integrated with the fuel injection pump. This short control rod in its return acts on the control bushing and the control bushing is acting on a cross-head of the pump piston, which cross head is rotating the pump piston. Thus, there exist three engaging points at each of which there exists some play. Even if these plays are extremely small they must be added up and the summed up plays result in a reduction of the accuracy of the control.

The invention has as an object to simplify and to make more precise the control of the fuel amount supplied or injected by constructional units of the mentioned type having integrated therein a fuel injection pump and a fuel injection nozzle. The invention essentially consists in that the crank pin is protruding from the front end of the housing of the fuel injection pump at the area of the driven end of the pump piston and is engaged by the control rod arranged outside of the constructional unit formed of fuel injection pump and fuel injection nozzle. In view of the crank pin of the regulating member extending out of the pump housing at the area of the driven end of the pump piston and in view of the control rod being arranged outside of the pump housing immediately acting on the crank pin, only the play between crank pin and control rod need be considered and the total play within the movement transmission path from the control rod to the fuel injection pump piston is reduced to a minimum. Moreover, the construction is substantially simplified. In view of the crank pin protruding at the upper end of the fuel injection pump housing out of this housing, the control rod can be arranged in an easily accessible area. Mounting of the control rod can now easily be effected. The control rod is provided with claws clamped to the control rod and immediately acting on the crank pin. Also the clamping device for these claws is easily accessible so that the various pump elements can be adjusted in a simple manner. In total, there results a simple adjustment of the pump elements and a high precision of the control.

The invention is further illustrated with reference to the drawing schematically showing an embodiment of the invention.

In the FIGURE of the drawing, there is shown an axial section through the housing of the fuel injection pump.

In the drawing, 1 is the fuel injection pump housing, 2 is the unit comprising the fuel injection nozzle, 3 is the pump piston bushing, 4 is the pump piston and 5 is the return spring for the pump piston, which return spring is supported against the upper spring washer 6 connected to the pump piston. 7 is a push rod acting on the pump piston with interposition of a pressure-transmitting member 8.

A regulating member 10 is rigidly connected to the driven end 9 of the pump piston 4 and is simultaneously forming the support for the spring washer 6.

The regulating member 10 is thus arranged between the upper spring washer 6 and the push rod 7 forming the drive member for the pump piston 4. The regulating member 10 is designed as a crank having its crank pin 11 outwardly protruding from the upper end of the fuel injection pump housing 1, a claw 12 being clamped to the control rod 13 by means of a screw 14 and acting on this crank pin. This arrangement is made possible by arranging the regulating member 10 with its crank pin 11 above the upper spring washer 6.

What is claimed is:

1. Fuel injection pump for internal combustion engines operated with fuel injection in particular Diesel engines, of the type in which fuel injection pump and fuel injection nozzles are integrated to a constructional unit associated to one engine cylinder, the pump having a housing and an internal pump piston rotatable via a regulating member by a drive member for adjusting the amount of fuel injected and being loaded by a return spring acting on the pump piston against the action of a piston drive member with interposition of a spring washer, the regulating member being formed of a crank having a crank pin parallely extending relative to the piston axis and being rigidly connected to the piston or manufactured for forming with the piston one single piece, the crank being arranged at the driven end of the piston between drive member and spring washer, and a control rod acting on the crank pin, characterized in that the crank pin protrudes through an aperture in the front end of the housing at the area of the driven end of the piston, said aperture facing parallel to the direction of the axis of the piston, said crank pin being engaged by the control rod arranged outside of the constructional unit formed of fuel injection pump and fuel injection nozzle.

2. In a fuel injection pump for an internal combustion engine of the kind including a pump housing having an end wall, a side wall and an internal barrel and an injection nozzle, a pump piston mounted in said barrel for reciprocation along the axis of the piston, said piston being driven from one end by means operating through said end wall and being rotatably adjustable in said barrel for adjusting the amount of fuel supplied to said nozzle, an improved control means for adjusting the rotational position of said piston comprising a crank rigid with said piston at the driven end of said piston and having a crank pin extending parallel to the piston axis and protruding through an aperture in said end wall at the driven end of said piston, said aperture facing parallel to the direction of the axis of said piston, and reciprocal regulating means located wholly outside said housing and cooperating with said crank pin outside said housing to adjust the rotational position of said crank pin and said piston.

3. A fuel injection pump as in claim 2 including a drive member for said piston arranged to reciprocate along the axis of said piston, a washer interposed between said drive member and said driven end of said piston and a spring in said barrel urging said piston toward said drive member, said crank being located between said drive member and said washer.

* * * * *